US005829349A

United States Patent [19]

Fitzgerald et al.

[11] Patent Number: 5,829,349

[45] Date of Patent: Nov. 3, 1998

[54] APPARATUS FOR RECEIVING AND COMPACTING GARMENTS

[75] Inventors: Robert Matthew Fitzgerald, Norcross; Eugene O. Gresens, Suches; Ward Pafford Broom, Snellville, all of Ga.

[73] Assignee: Innovative Product Achievements, Inc., Duluth, Ga.

[21] Appl. No.: 877,278

[22] Filed: Jun. 17, 1997

Related U.S. Application Data

[62] Division of Ser. No. 592,062, Jan. 26, 1996, Pat. No. 5,713,270.

[51] Int. Cl.[6] ..... B30B 9/00; A47B 81/00

[52] U.S. Cl. ..... 100/102; 100/233; 232/1 B; 232/43.3; 312/211; 312/224

[58] Field of Search ..... 100/102, 229 A, 100/233, 299; 312/211, 224, 327, 328; 232/43.3, 1 B

[56] References Cited

U.S. PATENT DOCUMENTS

| | | | |
|---|---|---|---|
| 165,252 | 7/1875 | Pike . | |
| 2,478,815 | 8/1949 | Forman . | |
| 2,888,307 | 5/1959 | Graves et al. | 312/211 |
| 3,249,294 | 5/1966 | Hughes et al. | 232/43.3 |
| 3,455,621 | 7/1969 | Kingsley | 312/211 |
| 3,696,737 | 10/1972 | Wikner . | |
| 3,728,849 | 4/1973 | Lundahl . | |
| 3,752,061 | 8/1973 | Hirsch . | |
| 4,519,308 | 5/1985 | Eberle | 100/233 |
| 4,552,061 | 11/1985 | Brutsman | 100/229 A |
| 4,594,942 | 6/1986 | Denneboom | 100/233 |
| 4,896,593 | 1/1990 | Slusser | 100/233 |
| 5,638,985 | 6/1997 | Fitzgerald et al. | 221/125 |

*Primary Examiner*—Stephen F. Gerrity
*Attorney, Agent, or Firm*—Bernstein & Associates

[57] ABSTRACT

An apparatus and method for collecting and compacting articles, such as hospital scrub garments. Included is a cabinet assembly, having user and operator accessible doors; collection bags and support associate with the cabinet; a control assembly including a microprocessor and receiver board capable of recognizing an authorized user and permit him or her access to the apparatus, and optionally a video monitoring system; a drive assembly comprising a drive motor, arm linkage, drive chain and sprockets; a pair of sweeping arms operable by the drive assembly and which cooperate with a pair of packing arm assemblies. The sweeping arms urge garments deposited by authorized users downward and to the side in the cabinet and the packing arm cooperates to compact garments which have dropped into the collection bags. A method is disclosed for selectively identifying and permitting user access to the apparatus and for automatically processing received garments into a compacted condition in the collection bags.

8 Claims, 11 Drawing Sheets

APPARATUS FOR RECEIVING AND COMPACTING GARMENTS

This is a divisional Ser. No. 08/592,062 filed on Jan. 26, 1996 (now U.S. Pat. No. 5,713,270).

FIELD OF THE INVENTION

The present invention relates to apparatus for receiving and compacting articles, and more particularly to apparatus for accepting garments into a compartment and compacting them therein.

BACKGROUND OF THE ART

Scrub garments are uniforms typically worn by doctors, nurses, and other medical workers in hospital operating rooms or other locations where the workers are likely to be in immediate proximity with patients. These scrub garments are hereafter called "scrubs". Scrubs provide an easily-changed launderable barrier between the wearer and the patient, helping to prevent the patient from exposure to germs or infectants on the wearer's body or street clothing, and also helping to protect the wearer's body from direct physical contact with a patient.

Scrubs usually are two-piece garments, consisting of a top or shirt and a bottom or pants. The tops and bottoms are stocked in different sizes to accommodate the needs of individual wearers. Scrub jackets also are worn by doctors and others. Soiled scrubs are collected for laundering and subsequent reuse, but scrubs must be periodically replaced due to wear and tear encountered in normal use as well as the effects of repeated launderings using the high temperatures and detergents required to clean and sterilize the soiled scrubs.

Hospitals normally make scrubs available to doctors and other medical workers at no direct cost to those users. Although each user is supposed to have only a limited number of scrubs at any given time for his or her personal use, some users will hoard scrubs of their size to maintain their own personal reserve. Other users may appropriate extra sets of scrubs for their own personal use, at home or elsewhere outside the hospital. These and other improper uses of scrubs contribute to an unacceptable shrinkage in the inventory of scrubs maintained by the institution for use by authorized persons.

This inventory problem is aggravated by careless handling; where scrubs are stacked for use by anyone, some people will withdraw a scrub from within the pile instead of removing the scrub at the top of the pile. This action often inadvertently dumps one or more clean scrubs from the pile onto the floor. That scrub must be relaundered before use, thereby reducing the remaining useful life of the scrub without the benefit of its use before relaundering. Both the shrinkage of the scrub inventory and the need for relaundering scrubs due to careless handling of increases the cost of providing and maintaining a sufficient supply of scrubs.

Some hospitals try to control the distribution of scrubs by requiring users to check out scrubs from personnel at central locations. Using this approach, each authorized individual is permitted to have no more than a certain number of scrubs in his or her possession at any time. The individual most return soiled scrubs to receive credit for clean scrubs. Although this approach can alleviate the problems mentioned above, it is expensive to maintain. Many hospitals are large enough to require several scrub-dispensing locations throughout the hospital. Furthermore, because hospitals never close, scrub dispensing locations must be staffed around the clock. The direct and indirect labor costs of that staffing add significantly to the overall cost of maintaining an adequate inventory of scrubs.

Regarding the collection of soiled scrubs, manual collection suffers the disadvantage of human error, forgetfulness, and the like. There is a need for an automated operating and tracking system that would identify a user by a unique identification means, and associate the garments that user turns in for collection. Tracking of those garments would need to correlate with subsequent issuance of clean garments so that only those users which have turned in their scrubs can obtain new ones. Such a system would reduce the number of scrubs lost or stolen.

Because the accumulation of a large number of scrubs in collection area can result in a surprisingly large volume of material, it would be desirable to have a system that would automatically compact the scrubs in the collection area to preserve space, which is frequently in short supply at hospitals.

SUMMARY

The present invention generally provides an apparatus that can identify a particular user and collect the scrubs from that user in a manner that permits subsequent identification of that user for issuance (by a separate apparatus, preferably) of clean scrubs.

In a preferred embodiment of the present invention, an apparatus is provided having a cabinet housing, a control assembly which can identify authorized users, permit access to the apparatus and give the user a "credit" for scrubs deposited therein, a door subassembly for receiving scrubs, a drive assembly and a sweeping assembly and packing assembly for moving the scrubs within the cabinet and compacting them.

The cabinet has a lower portion containing an operator accessible pair of doors, a compartment therein which has at least one, and preferably two garment collection bags supported therein; a middle portion having a door subassembly for permitting users to deposit garments only when the user has been properly identified; and, an upper portion having an operator accessible door, behind which is a shelf for supporting various components.

The control assembly comprises, in summary, a microprocessor and receiver board for transmitting and receiving signals to various parts of the apparatus. Optionally, a video camera for detecting images of users and garments, a video recorder for recording those images, and a monitor screen for viewing those images, is provided which is responsive to actuation and shutoff signals from the microprocessor.

The door subassembly has a pivoting door compartment, with a pull handle; a locking mechanism responsive to the control assembly for controllably permitting or denying access to the door; and, a means for sensing the passage of garments through the subassembly comprising a photosensor.

The drive assembly comprises a drive motor responsive to signals from the control assembly, a drive shaft, arm linkage, drive and driven sprockets, and a drive chain.

The sweeper/packing assembly comprises a pair of sweeping arms and a pair of packing arms. The first sweeper arm comprises a curved oblong plate having a portion that contacts and sweeps the garments, and has an aperture through which an axle passes. The axle is connected to the drive assembly. A second sweeper arm, similar to the first sweeper arm, is mounted opposite the first sweeper arm in the cabinet and is also operably connected to the drive assembly. The first packing arm comprises a pair of extension members, between which is rotatingly mounted, at one end, a wheel on a pin, and at the other end, a pin pivotably connected to a mounting bracket. The bracket is attached to the inner wall of the cabinet. A spring is attached to the packing arm and the cabinet to bias the packing arm in an upward position. Preferably, at the wheel end of the packing arm is a broad surface plate capable of contacting the scrubs. The second packing arm is similar to the first packing arm, in mirror image.

The sweeper arm and packing arm cooperate as follows. A cammed portion of the sweeping arm edge can contact the packing arm wheel. As the sweeping arm rotates, the cammed surface contacts the wheel, causing the packing arm to pivot from a down position to an up position and the contacting portion of the sweeper arm rotates downward, sweeping garments thereby downward and/or to the side. As the packing arm pivots upward, room is made for garments therebelow. As the motor completes its cycle, the sweeper arms counter rotate back up to their initial position and the packing arms likewise counter pivot into the down position in response to movement of the cammed surface of the sweeping arm against the wheel. The downward movement of the packing arm compacts the garments in the bag. The first sweeping arm and packing arm operate together, as do the second sweeping arm and packing arm.

A method according to the present invention comprises identifying the authorized user; unlocking the user door; activating the monitoring assembly; depositing the garments in the door compartment; closing and relocking the door; sensing the passage of garments within the cabinet; activating the drive assembly; rotating the sweeper arms down to urge garments down and/or to the side of the cabinet and toward the collection bags; raising the sweeping arm;

It is therefore a principal object of the present invention to provide an apparatus that can detect an authorized user and receive garments deposited thereby.

It is another object of the present invention to provide an apparatus that can automatically sense when a garment has been deposited therein, guide the garment through the apparatus and compact a plurality of the garments into a collection bag.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
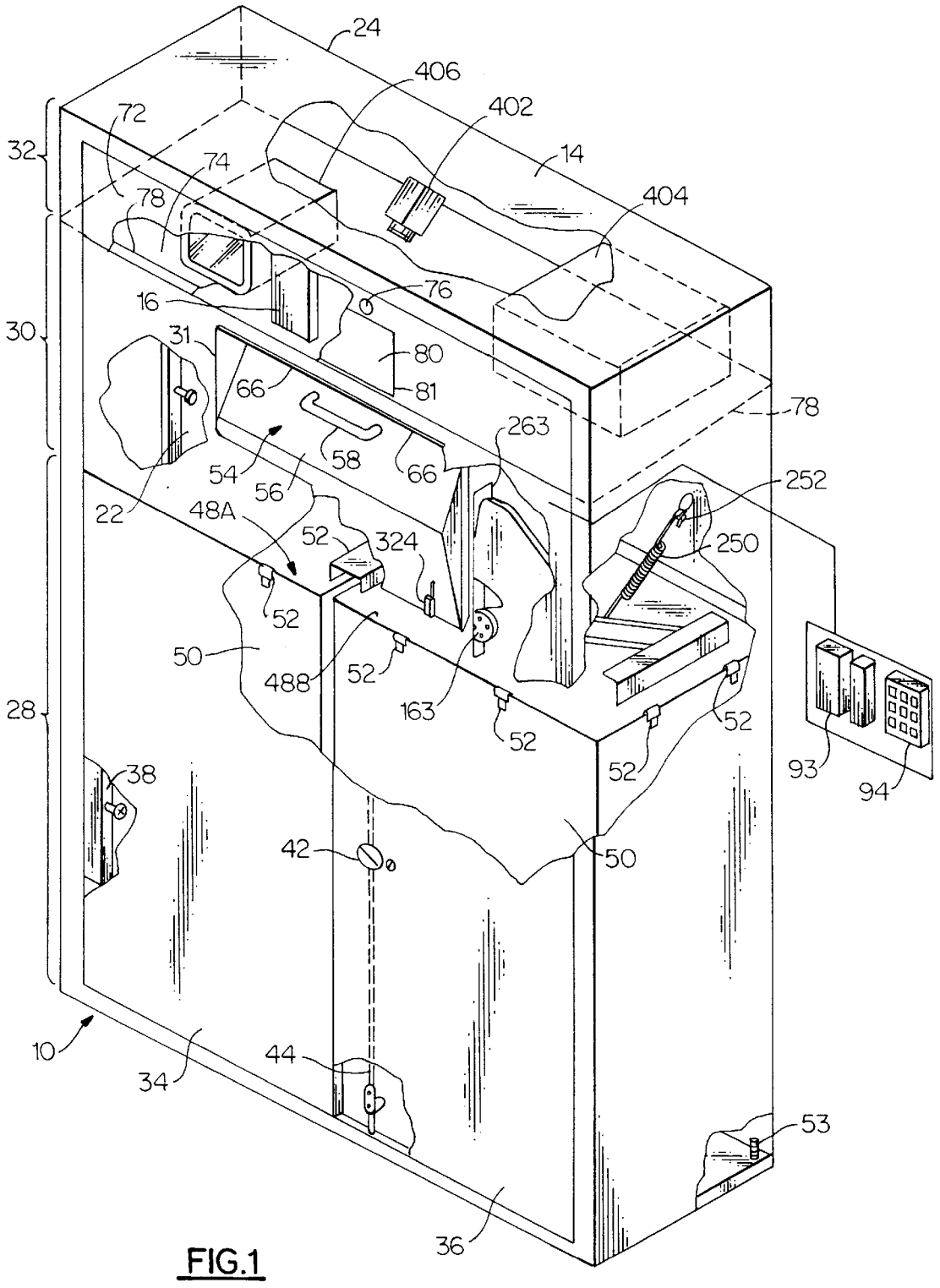
FIG. 1 shows a front perspective view in partial cutaway of the cabinet assembly in a preferred embodiment of the present invention.
Figure 2:
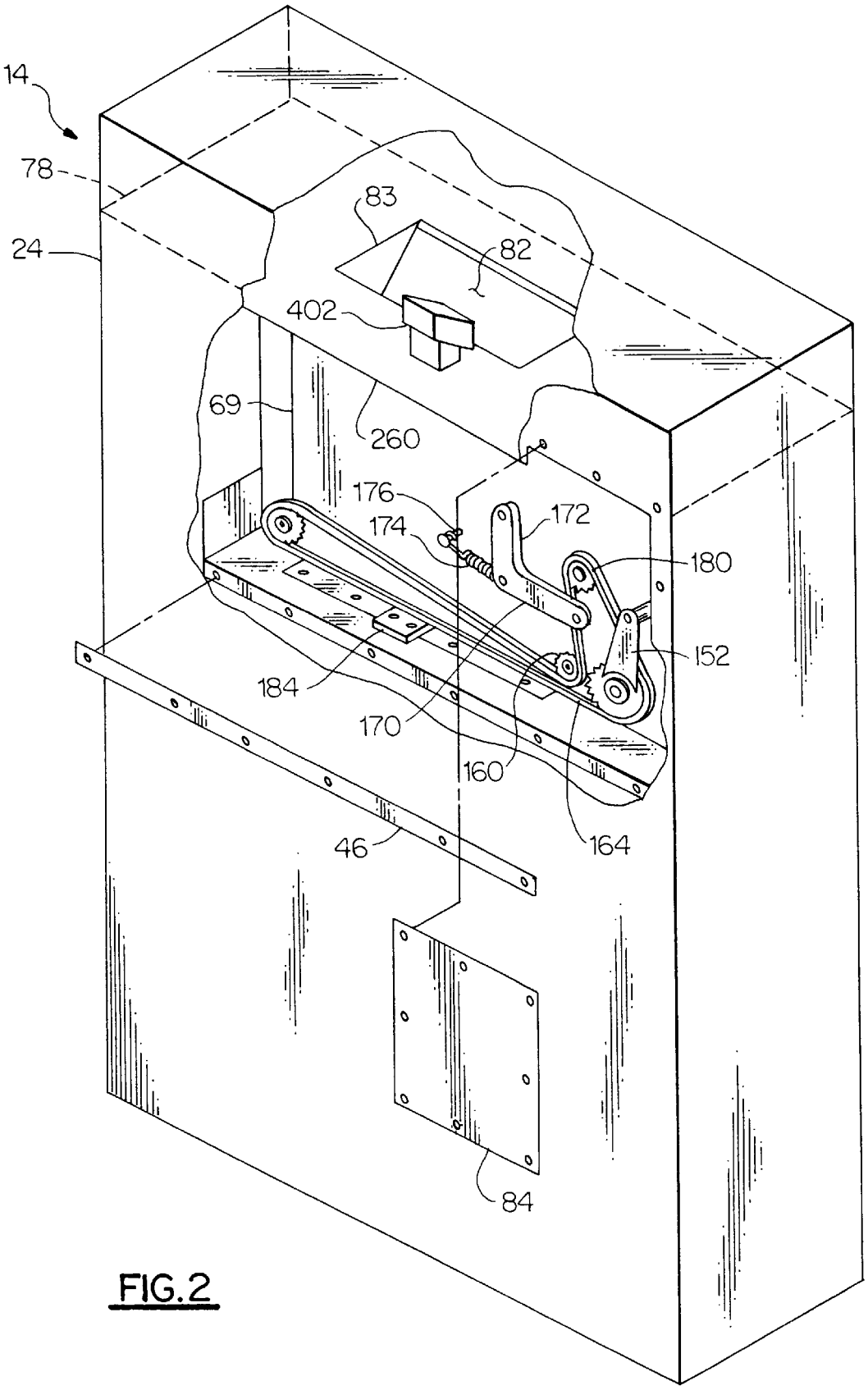
FIG. 2 shows a rear perspective view in partial cutaway of the cabinet assembly in a preferred embodiment of the present invention.
Figure 3:
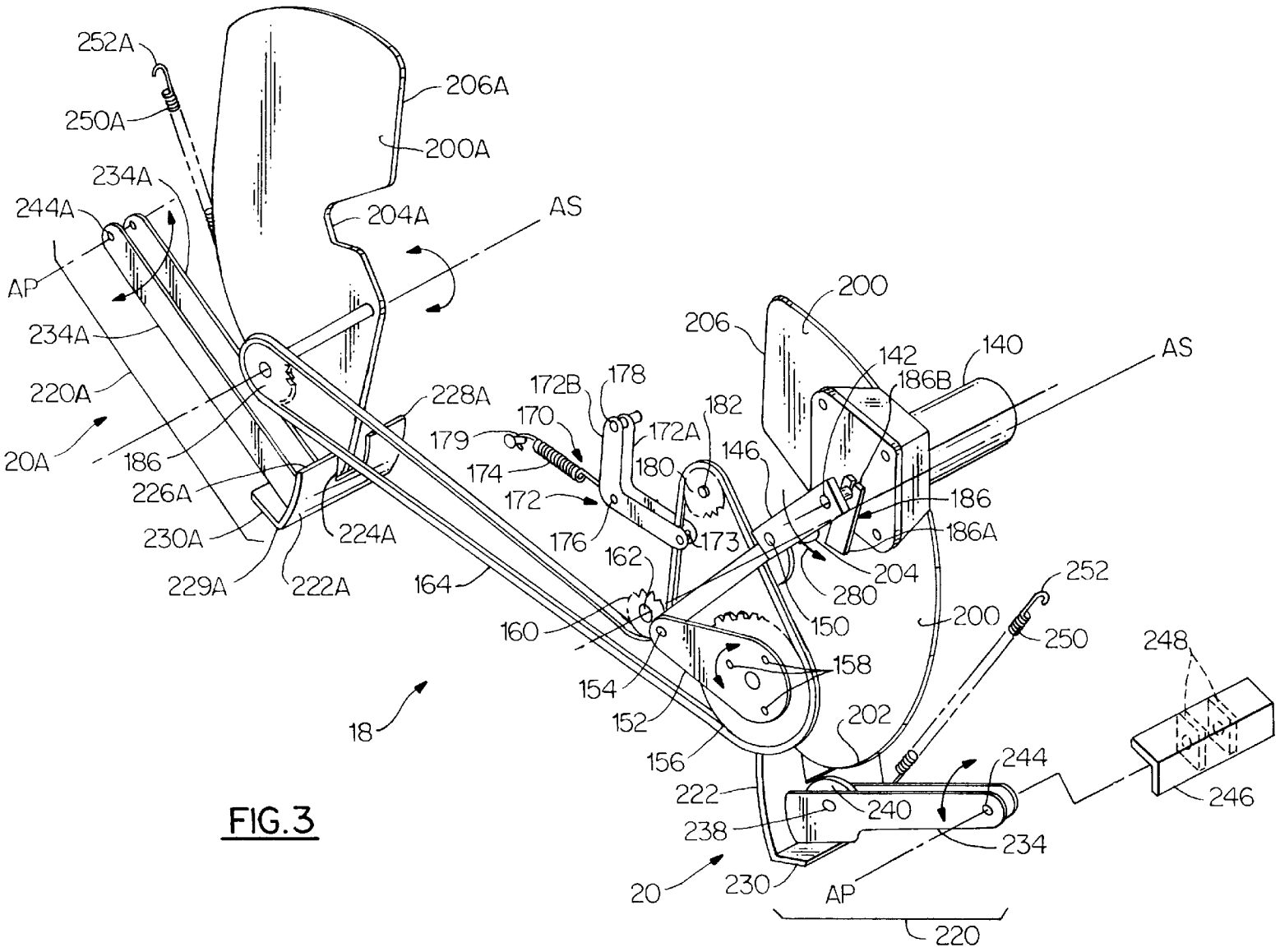
FIG. 3 shows a perspective view of the drive mechanism assembly and the sweeping and packing assemblies.

FIGS. 1–3 show an apparatus 10 for storing and compacting garments 5 (not shown) in a preferred embodiment of the present invention generally having a cabinet assembly 14, a control assembly 16, a drive mechanism assembly 18, and a packing assembly, the packing assembly comprising a mirror image pair of assemblies 20 and 20A.

The cabinet assembly 14 comprises a cabinet frame 24 constructed of a generally rigid material, such as sheet metal, plastic, composite or the like, having sufficient strength to support the components without appreciable warping or buckling. The cabinet 14 can be divided generally into a lower portion 28, a middle portion 30 and an upper portion 32; however, this distinction is merely for the purposes of discussion.

The lower portion 28 has a left front service door 34, a right front service door 36, each of the doors being supported by a hinge 38 and 40 (not shown) pivotally mounted to the frame 24. A locking latch 42 is mounted to one of the doors, preferably the right door 36, and has a latch rod 44 extending from an aperture in the bottom of the frame 24 to the top of the frame 24 just above the top of the doors 34 and 36. The doors 34 and 36 permit access to an interior compartment 48,which is divided into two areas 48A and 48B. Each compartment 48A and 48B has a garment collection bag 50 maintained in place by bag supports 52. The two bags 50 are used, versus one large bag, to reduce the weight an operator must carry when the bag 52 is full of compacted garments 5. Leveling feet 53 positioned proximate to each corner of the bottom of the cabinet 14 are user adjustable to maintain a level orientation of the apparatus 10 on a given surface.

The middle portion 30 has an opening 31 containing a user accessible door subassembly 54. Door subassembly 54 comprises a door face panel 56 having a bottom edge 57, a handle 58, a rear panel 60, side panels 61 and 62, a center dividing panel 63, and a door latch hasp 64.

Figure 2A:
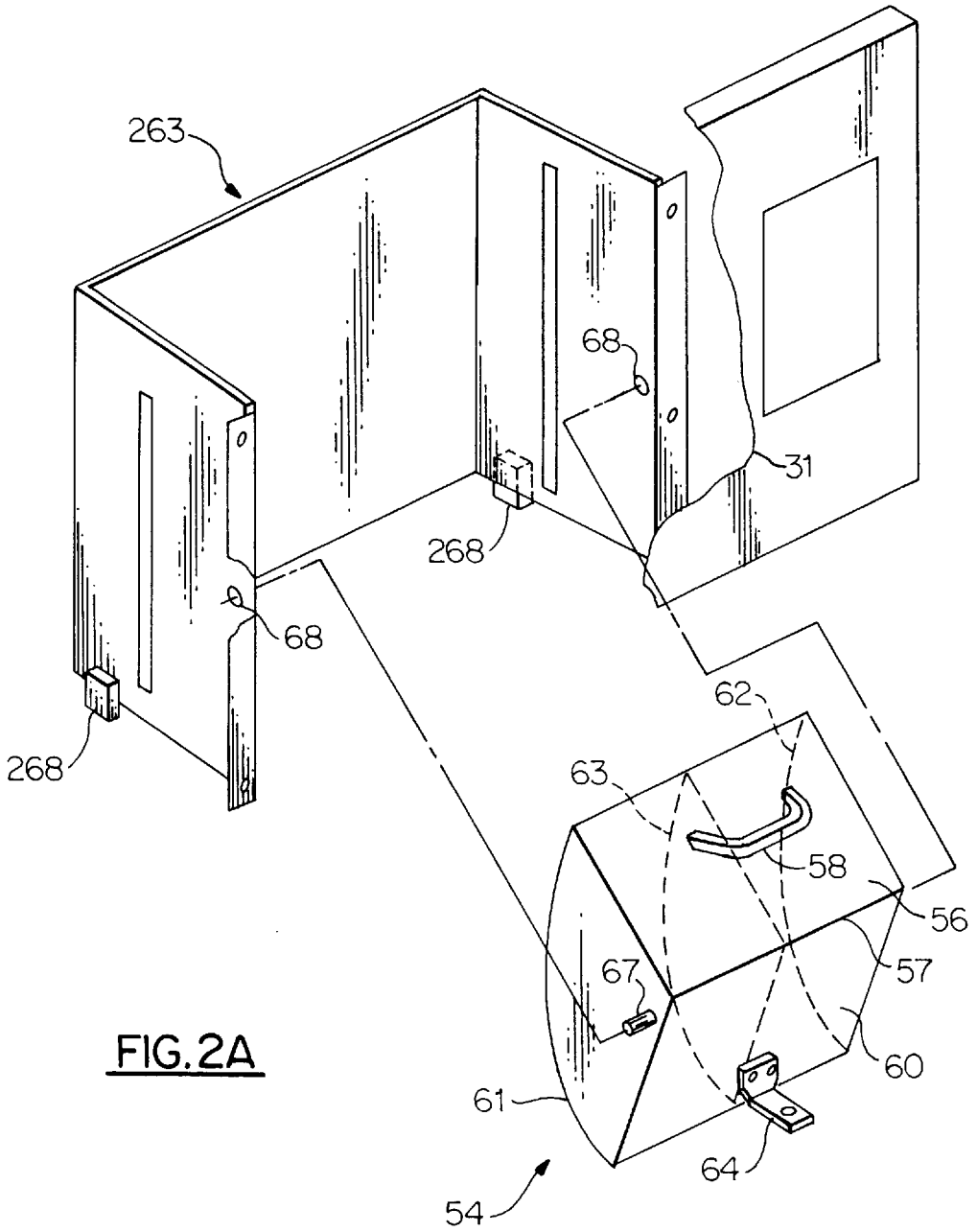
FIG. 2A shows a detail, partially exploded view of the door subassembly.
Figure 3A:
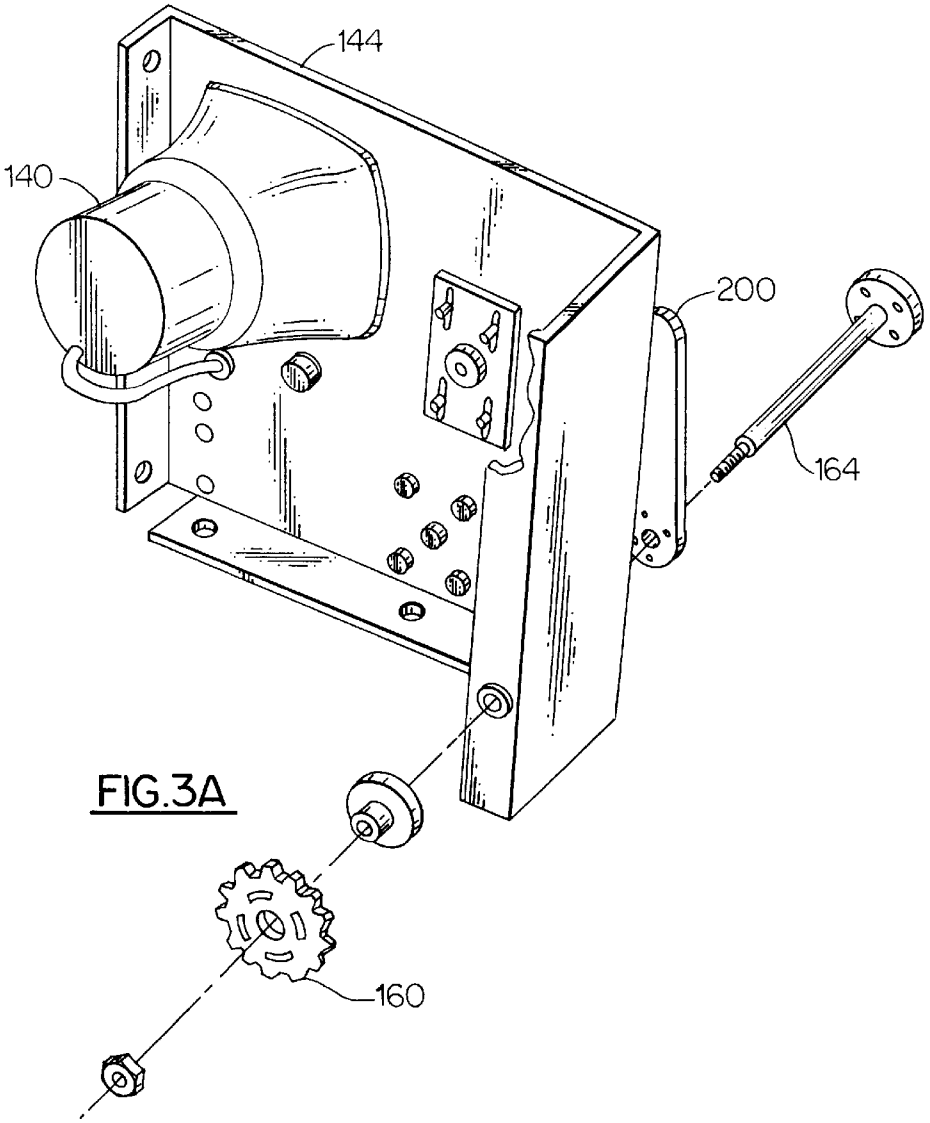
FIG. 3A shows a front view of the drive assembly.
Figure 2B:
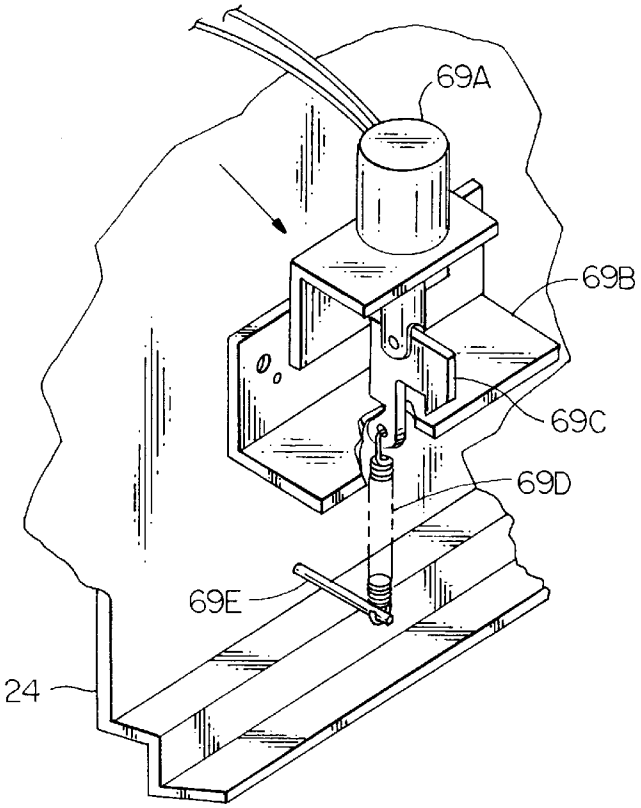
FIG. 2B shows a detail of the door subassembly locking mechanism.

A wiper strip 66 associated with the opening in the frame 24. The wiper strip 66 prevents garments 5 from becoming caught in the door panel 56. The door subassembly 54 pivots on a pair of pins which are received within apertures 68 in a bracket 263, as will be described in greater detail hereinbelow. The middle portion 30 generally houses the drive mechanism assembly 18 and the compacting assemblies 20 and 20A. FIGS. 2A and 2B shows a detail of the door subassembly 54 and a door locking mechanism 69 in electrical communication with the control assembly 16. The locking mechanism 69 comprises a solenoid 69A mounted to a bracket 69B. A lock pawl 69C is attached to the solenoid 69A and also to a spring 69D. The spring 69D is anchored to a nut 69E. The door hasp 64 is in contact with the lock pawl 69C, preventing a user from opening the door subassembly 54 until the control assembly 16 signals otherwise. The solenoid 69A is responsive to a signal from the control assembly 16, as will be described in greater detail hereinbelow, which causes the lock pawl 69C to be slid upward, disengaging the hasp 64. When the door closes, the hasp 64 re-engages the lock pawl 69C and locking the door subassembly 54.

The upper portion 32 of the cabinet 14 has an operator accessible door subassembly 70 comprising a door panel 72, a hinge 78 pivotally connected to the frame 24, and a lock 76. A horizontal shelf 74 associated with the frame 24 supports various equipment, including the control assembly 16. A one-way window panel 80 is positioned within an opening 81 in the panel 72. A second one-way mirror panel 82 is positioned within an opening 83 in the shelf 78.

A removable access panel 84 is attached to the rear of the cabinet 14, which permits operator access to the drive assembly 18.

FIG. 3 shows the drive mechanism assembly 18, which comprises a drive motor 140, which is connected via a power cord (not shown) to a power source (also not shown), such as a conventional 120V outlet. Alternatively, it may be desirable for the power source to be a battery, fuel powered motor, solar power, or other power source or combination of sources. For the purposes of the present disclosure, a conventional 120V electrical power source will be discussed. A motor shaft 142 extends from the motor 140. The motor 140 is mounted to a bracket 144, more clearly shown in FIGS. 3A, 3B and 4–6.

The shaft 142 connects to an aperture in a crank arm 146. The crank arm 146 rotates a full 360° in normal operation. The crank arm 146 is connected to a link arm 148 via a pin 150. The link arm 148 is connected to a drive arm 152 via a pin 154. The drive arm 152 reciprocates a portion of a whole turn. The drive arm 152 is connected to a drive sprocket 156 by a bolts 158. The drive sprocket is connected to a driven sprocket 160, which rotates about a pin 162. A drive chain 164 is operatively connected to the drive sprocket 156 and the driven sprocket 160. A chain tensioner subassembly 170, comprising an arm 172 composed of two L-brackets 172A and 172B (partially shown in the drawing), a spring 174 and a shoulder screw and nut (together) 178 which separate the arms 172A and 172B and connect the arm 172 to the frame 24. The arm 172 operatively engages the chain 164 between the arms 172A and 172B, sliding on a bearing 173 attached to the arms to maintain a relatively constant tension on the chain 164 and to prevent the chain 164 from coming loose. A spring anchor 179 is connected to the spring 174. A take up idler sprocket 180 is also operatively connected to the chain 164 and rotatingly connected to the frame 24 by a screw 182 and bushing 183. A chain rub block 184, shown in FIG. 2, prevents the chain from rubbing against the frame 24 or other parts. The chain 164 is also operatively connected to a second driven sprocket 186.

Figure 3C:
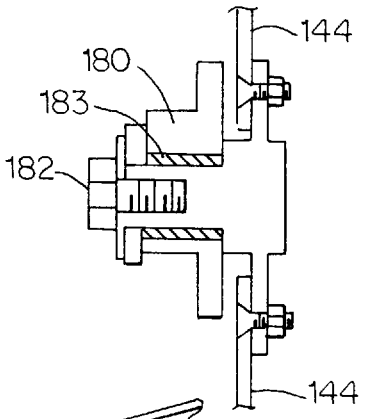
FIG. 3C shows a detailed side cutaway view of the sprocket 180 assembly.
Figure 3B:
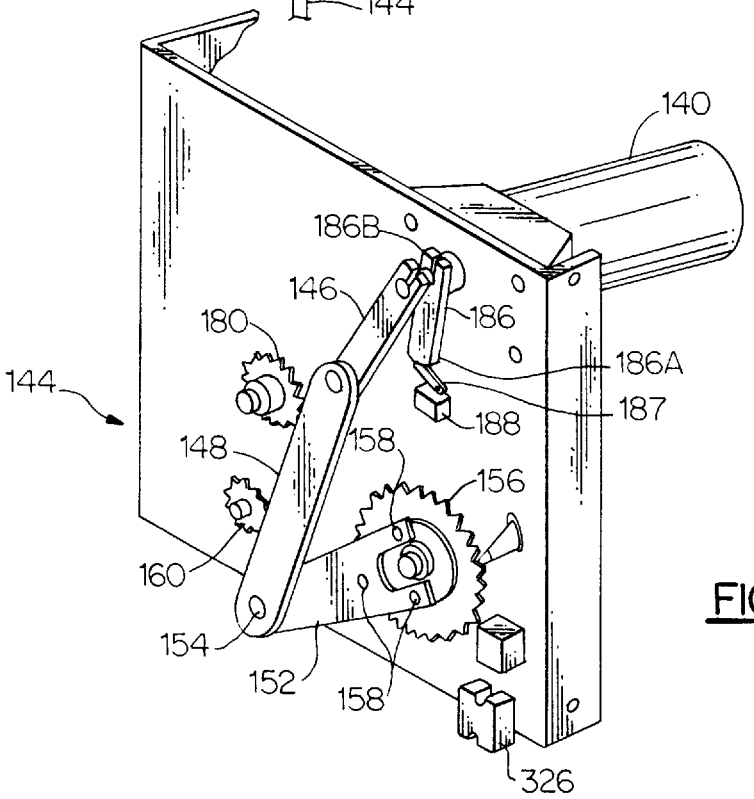
FIG. 3B shows a rear view of the drive assembly.
Figure 3D:
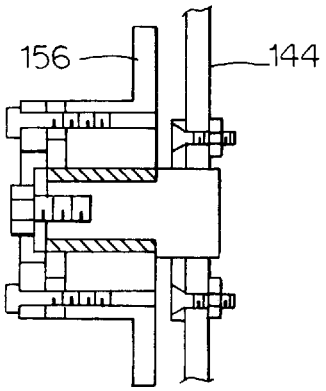
FIG. 3D shows a detailed side cutaway view of the sprocket 156 assembly.

The cycling of the drive assembly 18 controlled by a circuit, shown in FIGS. 3B, 3C and 3D. A trip bar 186 has a cammed distal edge 186A and is connected at its proximal end 186B to the drive shaft 142. The trip bar 186 can trip an arm 187 on a limit switch 188. The switch 188 is in electrical communication with the control assembly 16, as will be described in greater detail hereinbelow. The trip bar 186 is initially positioned just in contact with the arm 187 so as to close the circuit between the arm 187 and the switch 188. As the motor 140 and shaft 142 rotate the trip bar 186 rotates 360° until it again contacts the arm 187, causing the motor 140 to be signaled to shut off. In the event that the motor is rotating slower because of an increased load thereon caused by compacted garments 5, the trip bar 186 will take longer to complete its rotation cycle, thus lengthening the time between the initial and second contact closures of the arm 187 and the switch 188. This lengthened time is detected by the controller 16, as will be discussed in further detail hereinbelow.

FIGS. 3 and 4–6 show the packing mechanism assembly 20 comprising a first sweeping arm 200 which is a generally flat rigid sheet of metal, composite, plastic or other rigid material. The arm 200 has a cammed portion 202, a notch 204, a packing edge portion 206 and an aperture 208 capable of receiving the driven sprocket pin 162 therethrough. The pin 162 is rotatingly connected to a bearing 163 (shown in FIG. 1) which is mounted to the frame 24.

Figure 4:
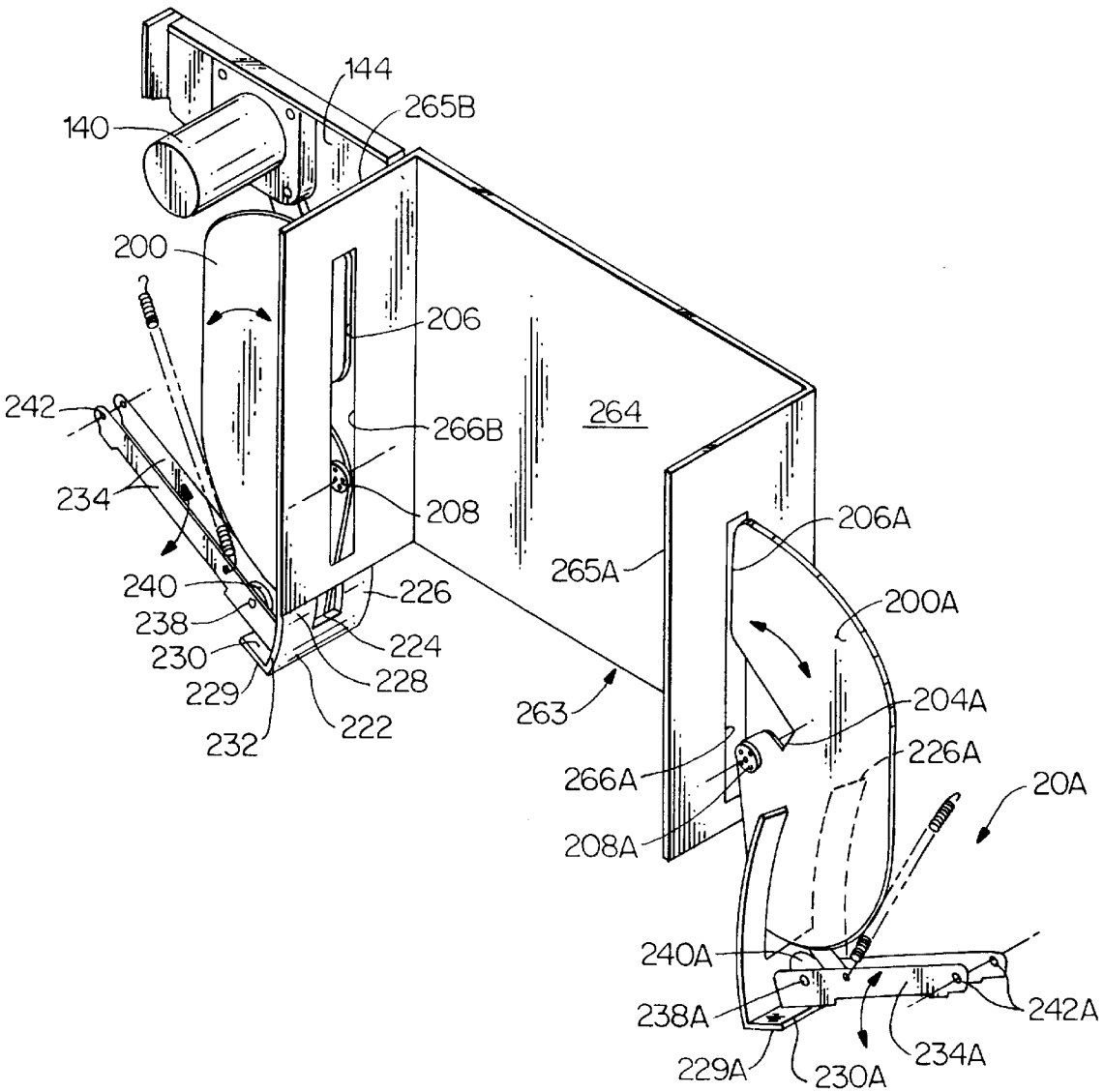
FIG. 4 shows a perspective view of the sweeping and packing assemblies in the starting or rest position.

A first packing arm assembly 220, shown in FIG. 4 as being on the right side of the figure, comprises a curved plate 222, which has a vertical notch 224 forming fingers 226 and 228. The front surface 229 of the plate 222 will contact the garments, as described in greater detail hereinbelow. An angled portion 230 extends from the lower edge 232 of the plate 222. A pair of elongated extension plates, together noted as 234, are attached to and extend from the plate 222. A pair of apertures 236 in both plates 234 at the portion nearer the plate 222 receives a pin 238. The pin 238 supports a wheel 240. A pair of apertures 242 at the opposite end of the plate 234 receives a pin 244. The pin 244 is pivotally connected to an angle bracket 246 by a pair of tabs 248 protruding from the bracket 246. The bracket 246 is mounted to the frame 24. A return spring 250 is connected at one end to one of the plates 234 by an aperture in the plate 234 and at the other end to a spring anchor 252, which is mounted to the frame 24. The resulting assembly structure 20 permits the arm 200 to reciprocatingly rotate about the pin 162 on an axis defined as Ap and the cammed portion 202 of the first arm 200 can engage the wheel 240.

FIGS. 1 and 4 show a support mounting bracket 263 which is attached to the frame 24 behind the door subassembly 54. The bracket 263 is C-shaped, when viewed from above and has a center panel 264 and side panels 265A and 265B. Each side panel has a vertical slot 266A and 266B, respectively. The sweeping arm 200 can pass partially through slot 266B and the sweeping arm 200A can pass partially through slot 266A. The center panel 264 acts in concert with the door subassembly 54 to guide garments 5 down into the compartment 48 and prevent a user from inserting his or her hand down the back of the door subassembly 54 to retrieve improperly garments 5 after they have been deposited.

A pair of photosensors 268 are attached to the bottom of the bracket 263 and are in electrical communication with the control assembly 16. The photosensor 268 can detect whether a garment has passed through the bracket 263.

A second packing mechanism assembly 20A consists of essentially the same components as the first assembly 20, in mirror image, with the assemblies 20 and 20A facing each other. Similar parts are numbered similarly, with an added letter "A" after the number, for differentiation. Additionally, the driven sprocket 186 is mounted to the pin 162A and is connected to the drive chain 164.

Figure 7:
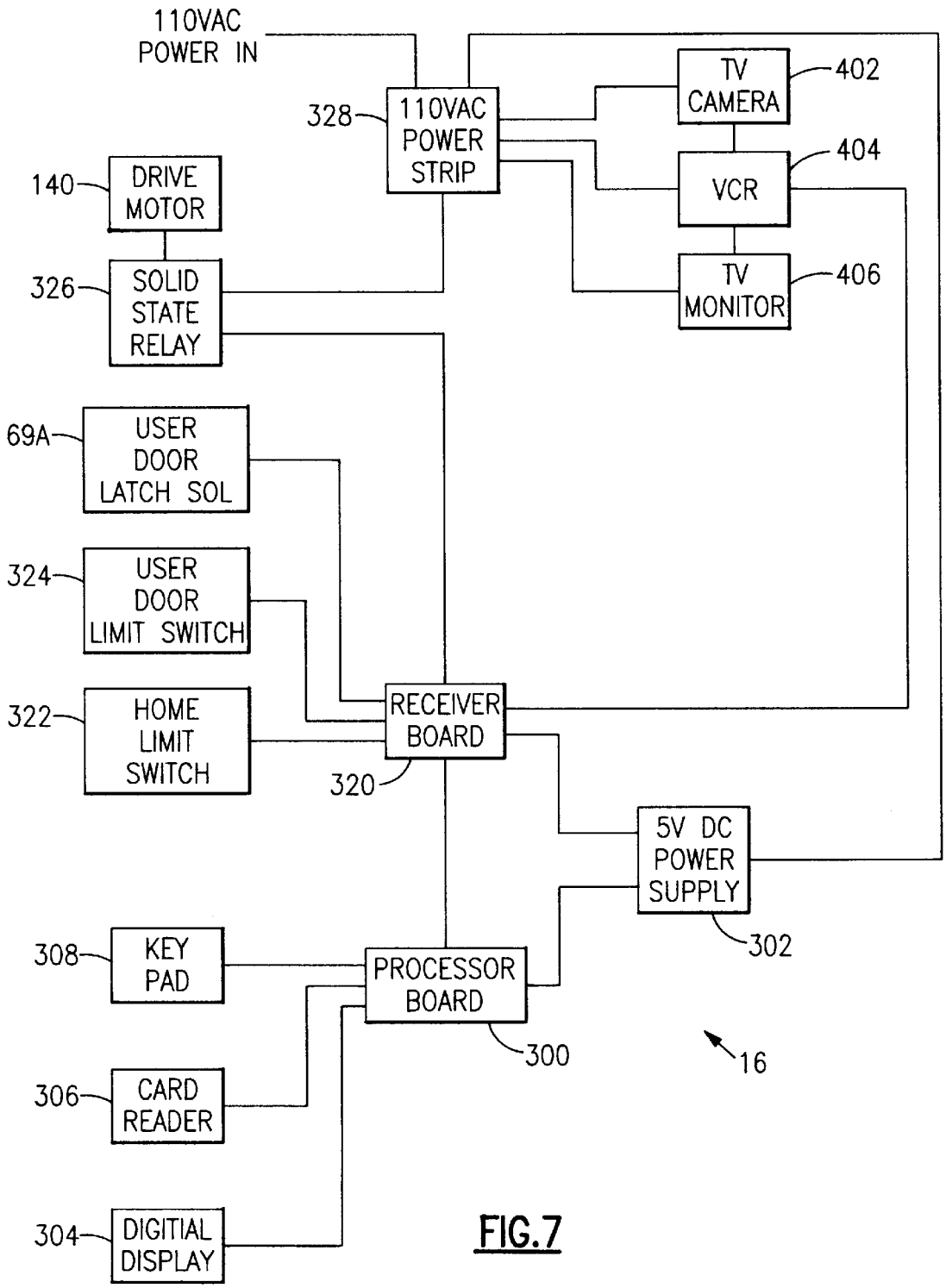
FIG. 7 shows a schematic diagram of the control assembly.

FIG. 7 shows the control assembly 16 comprises a microprocessor circuit board 300, well known to those of ordinary skill in the art, and capable of logic control of the apparatus 10. The processor 300 is operatively connected to several components. The processor 300 is powered by a 5V DC power supply 302.The processor 300 is connected to a digital display 304, such as an LED display. The nature and operation of device drivers, microprocessors, and related circuit elements are well known in the art, and those devices are not further described herein.

A conventional magnetic card swipe reader 306, known to those of ordinary skill in the art, is preferably of the kind having a slot through which a user can swipe an identification card (not shown) having a bar code or a magnetic strip encoded with information identifying the particular user. The construction and operation of such magnetic or bar code card readers, keypads, and digital displays are well known to those skilled in the art an need not be repeated herein. The card can contain user identification information, such as an identification number unique to the cardholder. The card will be used to present to the apparatus 10 sufficient identification as to activate the apparatus 10, as will be described in further detail hereinbelow. A keypad 308 permits user entry of identification information, such as a personal identification number or "PIN", which serves as confirmation of the user's identity. A receiver board 320 connects to a home limit switch 322 as well as to the power supply 302. A user door limit switch 324 connects to the receiver board 320, as does the locking mechanism solenoid 69A. A solid state relay 326, which is connected to the drive motor 140 and a power source (preferably a 110V AC power source) 328, is also connected to the receiver board 320.

Optionally, a monitoring assembly 400 can be included with the apparatus 10 for monitoring activity associated with the use or misuse of the apparatus 10. FIGS. 1, 2 and 7 show a video camera 402, a video cassette recorder 404, and a TV monitor 406 are positioned on the shelf 78 within the upper portion 32 of the cabinet 14. The one-way window 80 is positioned and mounted within the cutout portion 81 of the door panel 72 to permit the video camera 402 to view and record images, such as individuals, appearing in front of the apparatus 10. The one-way window 82 (shown in FIG. 2) permits the same video camera 402 to view the door subassembly 54. This monitoring assembly 400 can be used to provide additional security to detect individuals who may attempt to insert objects other than the appropriate garments 5 into the apparatus 10 or break in to or vandalize the apparatus 10.

The present invention can be used to accept garments of many kinds. A particularly appropriate garment is a conventional hospital top or bottom, usually referred to a "scrubs." Other hospital garments such as lab coats, uniforms, booties, or the like can be used. Indeed, many types of fabric material can be used, such as other articles of clothing or outerwear, towels, rags, and the like. The present invention can be adapted for use with nonfabric-like articles by modifying the size or shape of the sweeper arm 200 and the packing plate 222 to sweep and pack other articles, such as material for recycling. For example, the sweeper arm 200 can be adapted to have teeth or paddles along the packing edge portion 206 for more positively engaging and drawing items down into the compartment 48. The packing arm assembly 220 can be adapted to be larger and broader to pack different items. The reach of the packing plate 222 can be modified by altering the geometry of the sweeper arm 200, length of the plate 222 and/or the extension plates 234. The size and torquing strength of the motor can be enhanced to compress resistant material, such as plastic bags. Even plastic items, such as recyclable plastic containers can be used, which occupy significantly less space when compacted. Organic material, such as plant, tree or grass clippings can be packed, although in such an application one may not need the door subassembly 54. For the purposes of the present disclosure of the preferred embodiment, a hospital scrub garment 5 will be discussed. It is to be understood that any article that can be inserted, swept downward, and packed or compacted is contemplated as being within the scope of the present invention.

For the purposes of the following description of the method of operation an exemplary scenario is discussed in which users are hospital employees who routinely use scrubs, consisting of a top and/or bottom. Frequently, the user will remove their scrubs at the end of their day or shift and change into street clothes. The scrubs are normally not worn outside of the work environment because they may contain blood or other fluids and may contain contaminating biologics. Therefore, the user must deposit the scrubs in a storage apparatus, namely the apparatus 10 of the present invention. As previously described, it is important that the user be identified to the apparatus.

The present invention can be used in conjunction with a vending apparatus and method, such as that disclosed in co-pending U.S. patent application Ser. No. 08/371,363 (now U.S. Pat. No. 5,638,985 issued Jun. 17, 1997), entitled "Vending Apparatus and Method", which is incorporated by reference herein. Such an apparatus can be used to controllably dispense garments to identified and permitted users. In the same manner, the present invention can be used by identified people through the use of a magnetic card and reader system to acknowledge the deposit of garments into the apparatus 10.

Figure 8:
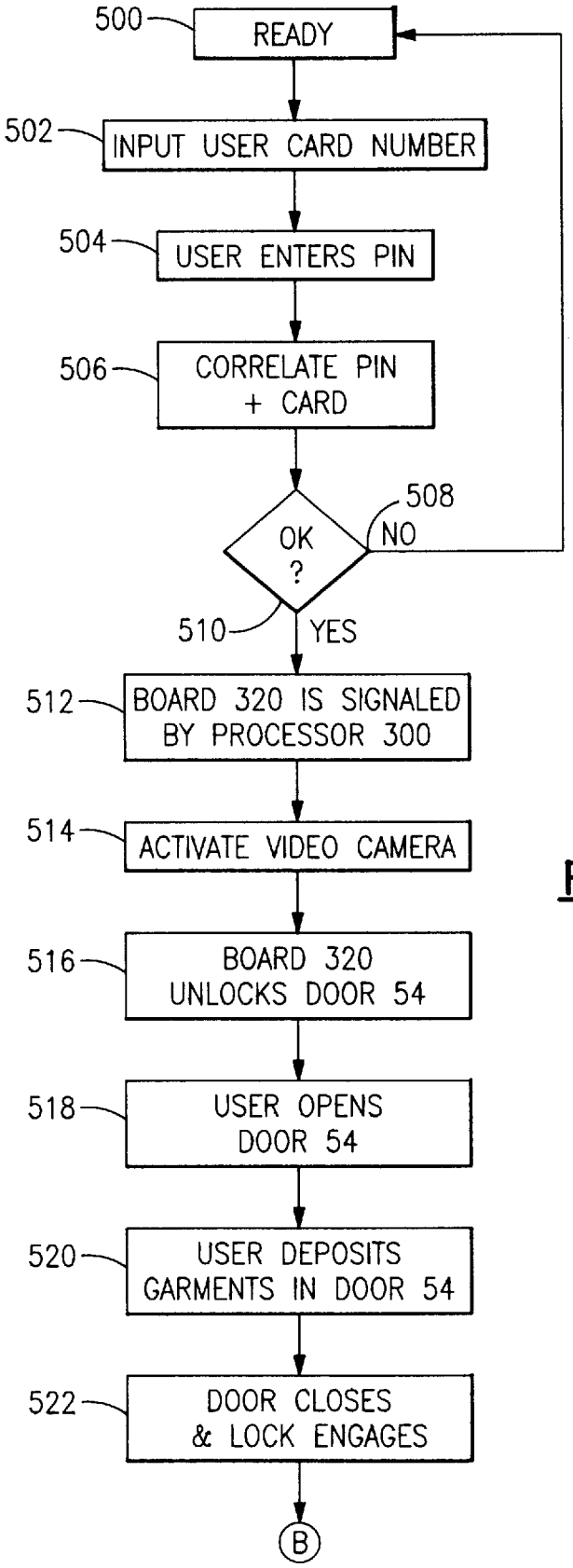
FIGS. 8–10 show a flow diagram of the method of the present invention.
Figure 9:
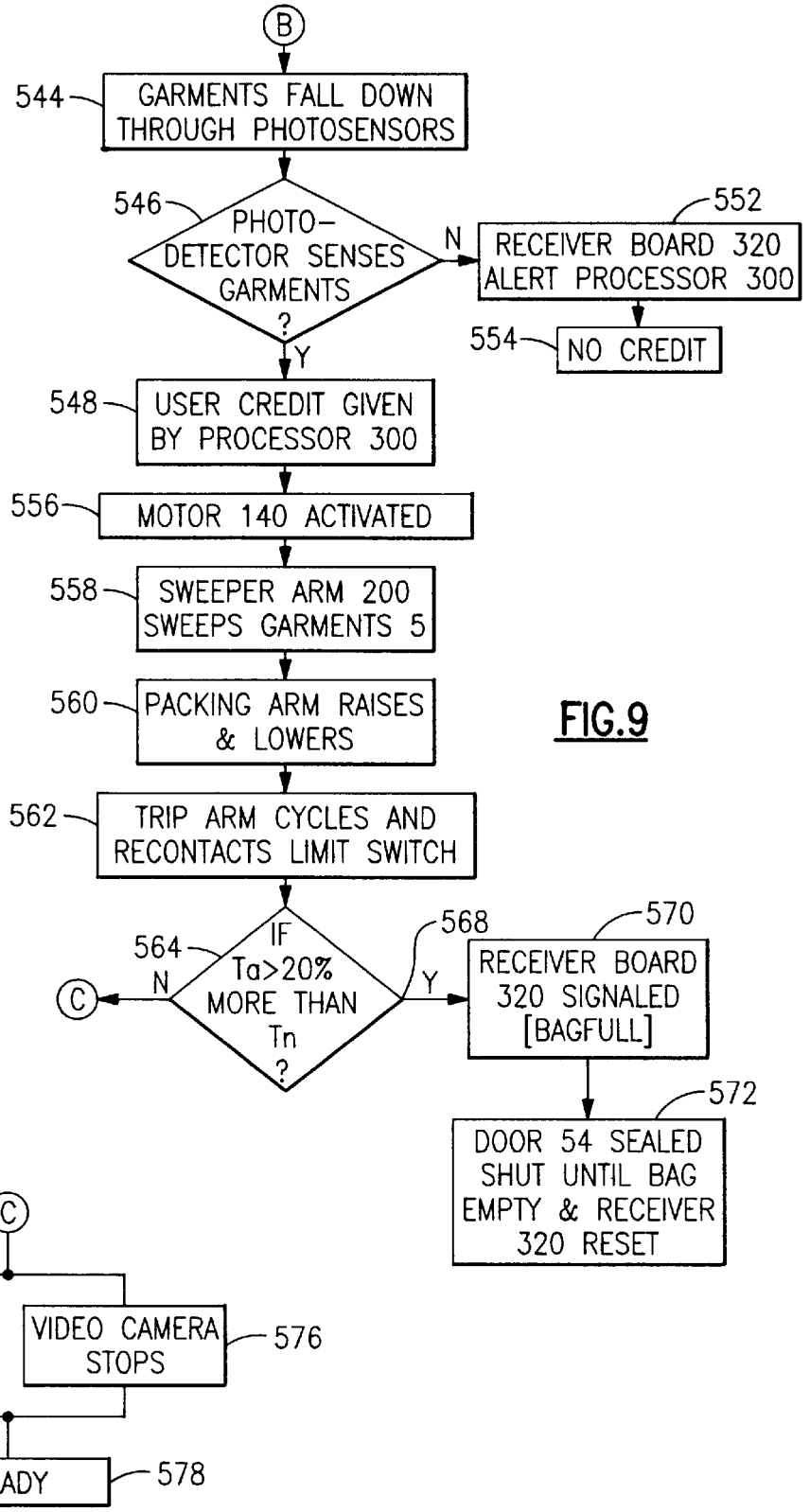
Figure 10:
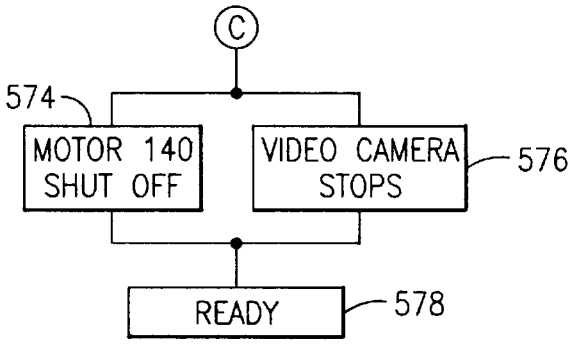

Turning to FIGS. 8–10, wherein the steps are numbered, the system starts in a ready condition, step 500. A user would first swipe his or her identification card at the magnetic card reader 306, step 502. The magnetic strip or bar code on the card would be read and entered into the processor 300, which can access memory data informing it of certain user information. The user then enters his or her PIN at the keypad 308, step 504. The processor 300 correlates the PIN number and the card number to make sure the cardholder is an authorized user, step 506. If the correlation is negative, step 508, the user is prompted to reenter their PIN. If the correlation is positive, step 510, the processor signals the receiver board 320, step 512. The video camera 402 is activated, step 514, and the door lock 69 is actuated responsive to a signal from the receiver board 320, step 516. The user pulls the handle 58 and opens the door subassembly 54, depositing the garments 5, preferably one garment on either side of the divider 63, and closes the door subassembly 54, locking the door closed. These actions are shown at steps 518, 520 and 522.

The video camera 402 records the activity of the user through one way window 80 and the activity of the door subassembly 54 through the one way window 82, with the camera lens having a wide enough viewing area to capture activity in both areas simultaneously. The video recorder 404 captures the recorded images for later viewing in case an improper or no deposit is made. The TV monitor 406 permits instant re-viewing of the tape.

As the garments 5 drop through the bracket 263 they pass through photosensors 268, step 544. The photodetectors 268 will either (1) detect the garments 5, step 546, in which case a positive detection is given by receiver board 320, step 548, and tells the processor 300 to issue a credit, or (2) not detect the garments 5, step 550, in which case the receiver board 320 detects the lack of expected photosensor 268 signal, step 552, and tells the processor 300 to not issue the user a credit, step 554. The credit information is stored in memory of the processor 300 and can interact with the processor of the vending machine (in the co-pending application identified hereinabove) to possibly block issuance of additional scrubs until the issued scrubs are returned properly in the apparatus 10.

FIG. 4 shows a detail of the apparatus 10 in the initial position, with the arms 200 and retracted in the up position, and the packing arm assembly 220 in the down position. For the purposes of the following discussion, the assembly 20A will be discussed in detail, with the understanding that the assembly 20 functions similarly in a mirror image manner.

The garment 5 drops into the compartment 48. As more and more garments 5 are deposited in the apparatus 10, they will begin to form a pile that will eventually approach the top of the middle section 30. After a garment is deposited and the door 54 is closed, then the receiver board 320 actuates the solid state relay 326 which starts the motor 140. The motor 140 rotates the shaft 142 in the direction of arrow 280 (counterclockwise in FIG. 3, when viewed from the rear of the cabinet 14). This causes the link arm 148 to rotate the drive arm 152, which in turn rotates the drive sprocket 156. The drive sprocket 156 causes the sweeper arm 200 to rotate counterclockwise. The drive sprocket 156 also engages the chain 164 and causes it to rotate the driven sprocket 160, which in turn causes the sweeper arm 200A to rotate clockwise. The packing edge portion 206A rotates inward and downward, sweeping any garments 5 that may enter the space between the two arms 200 and 200A.

Figure 5:
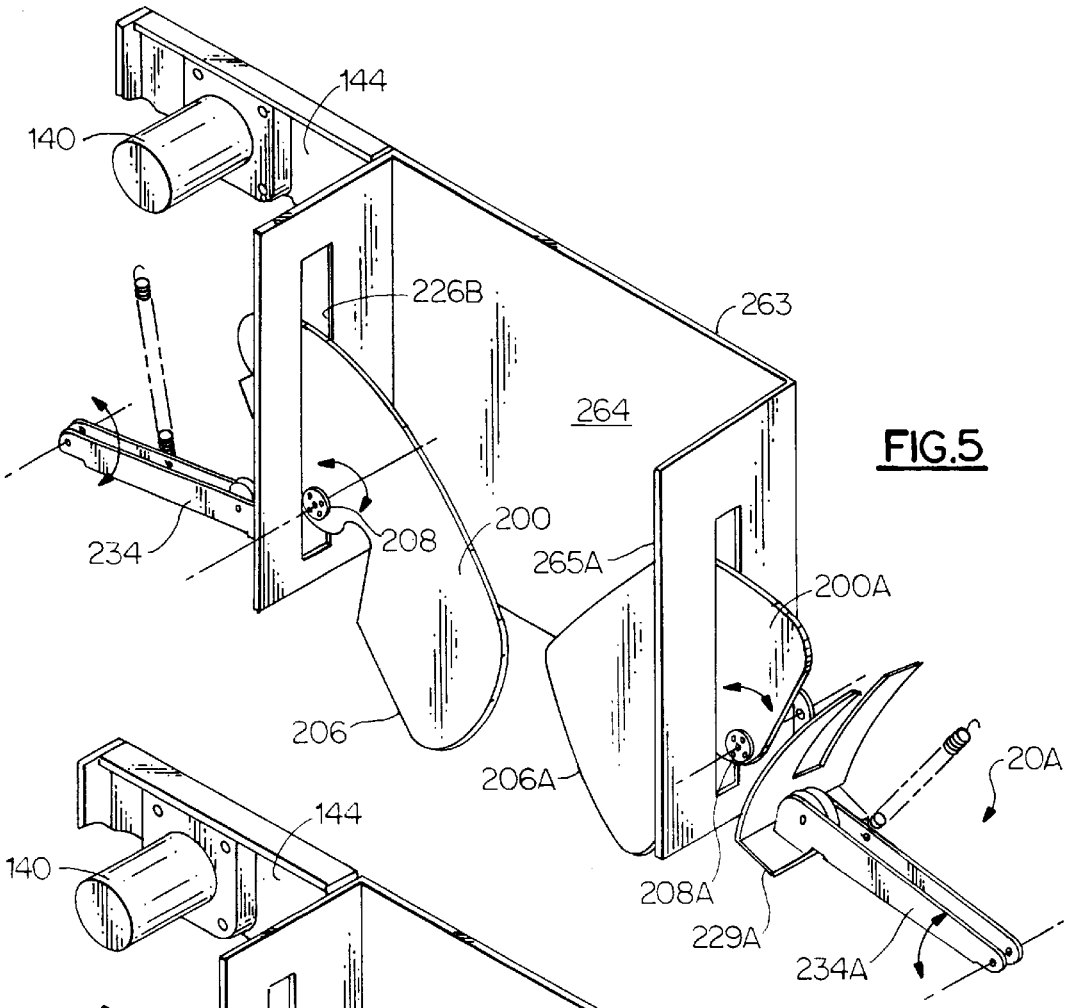
FIG. 5 shows a perspective view of a portion of the cabinet and the sweeping and packing assemblies generally midway through the cycle.
Figure 6:
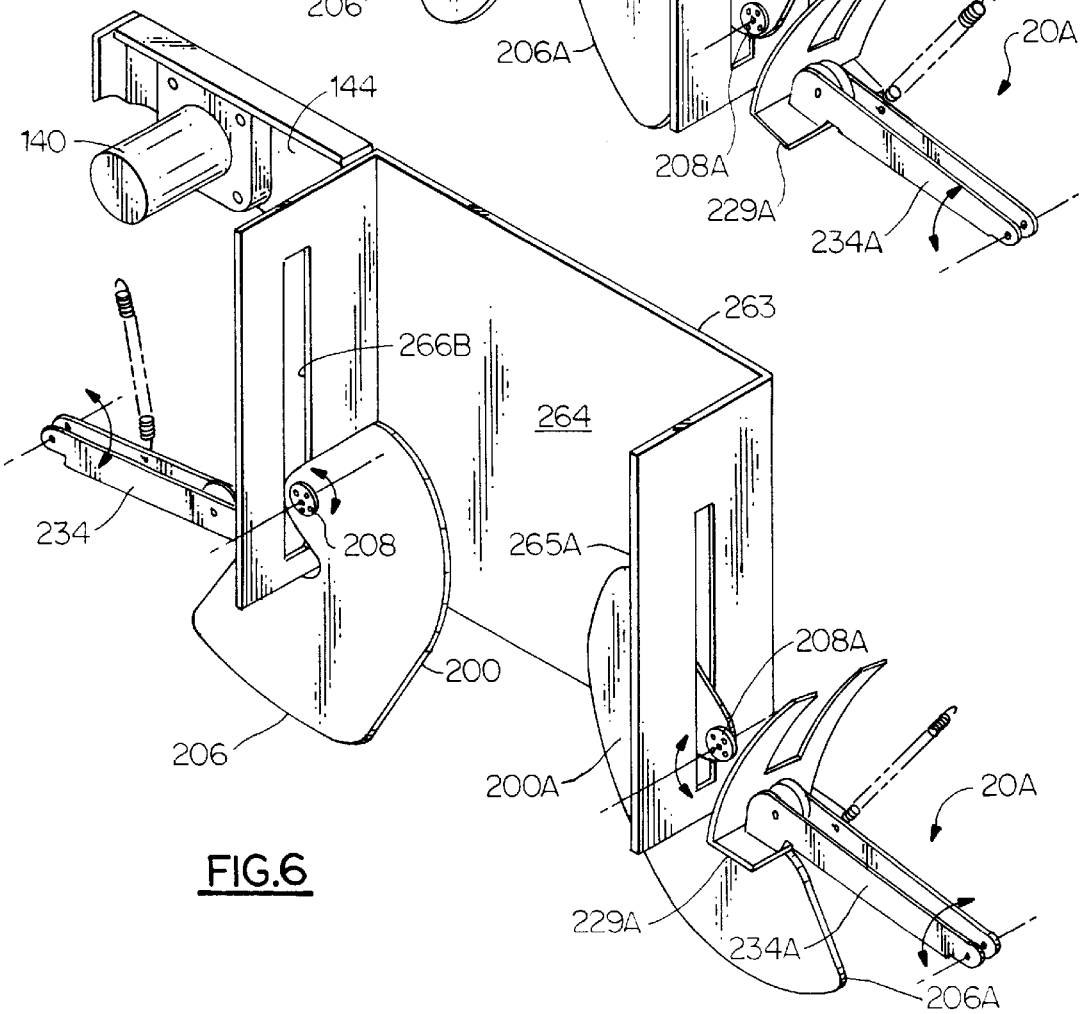
FIG. 6 shows a perspective view of a portion of the cabinet and the sweeping assembly in the down or fully swept position and the packing assembly in the up position.

FIG. 5 shows that, as the cam edge portion 202A rotates, it gradually disengages wheel 240A, which, because of the upward pull of the return spring 250A, cause the packing plate 222A to pivot upward to accept more garments 5. At the completion of the sweeping motion, as shown in FIG. 6, the packing edge portion 206A is in the downmost position, having swept the garment 5 downward and to either one side or the other of the cabinet 14 (when used in combination with edge portion 206), which ever side the garment 5 happens to move toward. The motor 140 continues to cycle in the same direction, with the arm 152 counter rotating and bringing the sweeping arm 200A back up into its initial raised position and pivoting the packing arm assembly 220A into is initial downward position.

When the trip arm 186 has made generally full 360°, or so, rotation, it comes again in contact with the arm 187 and closes a circuit with the limit switch 188, step 562. The time to achieve this complete rotation is defined as Tn, for normal time. The motor 140 stops, responsive to a signal from the receiver board 320 until the next activation by the processor 300 a user activates the system.

The receiver board 320 can sense the limit of garments 5 that can be reasonably compacted in the compartment 48 by a feedback mechanism. Upon activation, the drive mechanism 18 and packing mechanism 20 take a certain normal time Tn to complete the cycle, step 564. When garments are packed high enough in the compartment 48, the sweeping arms 200 and 200A will encounter increased resistance to movement, which cause a longer actual time Ta to complete the cycle. If the difference between Ta and Tn becomes greater than a given percentage, e.g., about 20%, step 568, the processor 300 shuts the motor 140 down. The receiver board 320 tells the processor 300 that the apparatus 10 is full and needs emptying, step 570. The signal can be an indicator light, audible signal, or other signal, such as signaling a remote indicator in a maintenance room, the indicator being electronically in communication with the apparatus 10. Under this condition, the door lock 69 will not open until the processor 300 is reset to indicate that there is no overload condition, step 572. However, if the difference between Ta and Tn is less than the given percentage, then the motor 140 is shut off, step 574, the video camera 402 and the recorder 404 are stopped, step 576, and the system returns to the ready, initial, condition, step 578.

Periodically, an operator can unlock the door latch 42, open the doors 34 and 36, and remove the garments compacted in the bag 50. An empty bag or bags 50 are replaced in the bag supports 52 and the doors are closed. When desired, an operator can unlock the lock 76 and open the door 72 in order to gain access to the video cassette recorder 404.

An advantage of the present invention is the simplicity with which the sweeping and packing motions are carried out, with reliable and few parts that can wear out or break down. The sweeper arm 200 mechanism not only draws garments 5 down the cabinet, but pushes them to one side of the cabinet 14 or the other, at which point the packing arm 220 can compact the garments.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

Claimed is:

1. An apparatus for controllably receiving and storing garments, comprising:

a) a cabinet having a top, bottom, sides, front, and back, capable of containing a plurality of said garments, said cabinet having at least one opening therein for receiving garments;

b) means associated with said cabinet for receiving said garments;

c) means associated with said cabinet for urging received garments downward inside said cabinet comprising i) a sweeping arm comprising at least one generally rigid curved plate having an aperture defined therein capable of receiving an axle about which said plate can rotate, said plate having an edge portion capable of contacting said garments and, as said plate rotates, urging said garments in said cabinet downward and/or to the side, and ii) a packing arm comprising a rigid elongated arm having a first end and a second end, said second end being pivotally mounted to a pin, said first end being capable of reciprocating pivotal movement responsive to the movement of said sweeping arm such that when said edge portion of said sweeping arm is rotated from a downward toward a upward position said second end of said packing arm pivots downward, thereby packing said garments downward while said sweeping arm rotates to allow additional garments to be received in said cabinet;

d) means for driving said urging means; and, e) means for controlling said drive means.

2. The apparatus of claim 1, wherein said receiving means comprises a door assembly pivotably associated with said cabinet, said door assembly providing restricted access to the interior of said cabinet.

3. The apparatus of claim 2, wherein said door assembly further comprises a locking means responsive to a signal from said controlling means.

4. The apparatus of claim 1, further comprising means associated with said cabinet for monitoring the area in proximity to said apparatus.

5. The apparatus of claim 4, wherein said monitoring means comprises a video camera and a means for storing images recorded by said camera, said monitoring means being in communication with said controlling means.

6. The apparatus of claim 5, wherein said at least one opening comprises a panel having a two-way mirror contained therein which permits said video camera to access images of the area around the outside of said apparatus.

7. The apparatus of claim 1, further comprising means associated with said cabinet for compacting said garments.

8. An apparatus for controllably receiving and storing garments, comprising:

a) a cabinet having a top, bottom, sides, front, and back, capable of containing a plurality of said garments, said cabinet having at least one opening therein for receiving garments;

b) means associated with said cabinet for receiving said garments;

c) means associated with said cabinet for urging received garments downward inside said cabinet comprising at least one generally rigid curved plate having an aperture defined therein capable of receiving an axle about which said plate can rotate, said plate having a cammed edge portion and an edge portion capable of contacting said garments and, as said plate rotates, urging said garments in said cabinet downward and/or to the side;

d) means for driving said urging means;

e) means for controlling said drive means; and, f) means associated with said cabinet for compacting said garments comprising an elongated member having a first end and a second end, said first end having at least one aperture defined therein capable of receiving a second axle, a wheel through which said second axle passes, at least one aperture defined in said second end capable of receiving a first pin, a mounting bracket associated with said cabinet capable of pivotally receiving said first pin such that said elongated member can pivot about said first pin, means for biasing said elongated member in a raised position defined as said first end being higher than said second end, but permitting said first end to pivot downward, said curved plate being positioned in proximity to said compacting means such that said cammed edge portion can contact said wheel during at least a portion of a cycle when said plate rotates about said first axle.

* * * * *